United States Patent [19]

Rut

[11] 4,438,644

[45] Mar. 27, 1984

[54] FORGING DEVICE

[75] Inventor: Tadeusz Rut, Poznań, Poland

[73] Assignee: Instytut Obrobki Plastycznej, Poznan, Poland

[21] Appl. No.: 153,783

[22] Filed: May 27, 1980

[30] Foreign Application Priority Data

Jun. 9, 1979 [PL] Poland ..... 216275

[51] Int. Cl.[3] ..... B21K 1/08

[52] U.S. Cl. ..... 72/356; 29/6; 72/403

[58] Field of Search ..... 72/353, 354, 403, 450, 72/399, 356; 29/6

[56] References Cited

U.S. PATENT DOCUMENTS

| | | | |
|---|---|---|---|
| 2,414,549 | 1/1947 | Nowak | 29/6 |
| 2,827,685 | 3/1958 | Cleghorn | 29/6 |
| 3,348,407 | 10/1967 | Rut | 72/450 |
| 4,041,755 | 8/1977 | Rut | 72/353 |
| 4,272,979 | 1/1981 | Rut | 72/403 |

FOREIGN PATENT DOCUMENTS

| | | |
|---|---|---|
| 733175 | 6/1955 | United Kingdom . |
| 1079255 | 8/1967 | United Kingdom . |

*Primary Examiner*—Leon Gilden

[57] ABSTRACT

The forging device is equipped with two upsetting-tool holders which are shaped as angular elements 7. They are installed between a head 1 and a base 11, are mounted slidably in a direction transverse to the head movement and are connected with the head by articulated connectors 6. The arms **7*b* of the angular elements 7 which are situated parallel to the head movement are equipped with upsetting tools 13. Between the upsetting tools 13 a gripper of the forged material is installed, which is composed of two jaws 2*a*, 2*b*. The arms 7*a* of the angular elements 7, which are transverse to the head movement, are mounted slidably with regard to the jaw 2*a* of the gripper in the direction transverse to the head movement. These arms 7*a* are pressed against the jaw 2*a* in the direction of the head movement and cause the clamping of the material between the jaws 2*a*, 2*b*. After the material has been clamped, the jaws 2*a*, 2*b*** remain immobile during the whole metal forming process. The device permits to upset a rod or a tube simultaneously at two places or to manufacture branched forgings, like crosses, T-shapes, Y-shapes and the like.

7 Claims, 11 Drawing Figures

FORGING DEVICE

This invention relates to a forging device having two upsetting-tool holders, installed between the forge head and base mounted slidably in a direction transverse to the head movement, and are connected with the head by articulated connectors, having in the upsetting area between the upsetting-tool holders, a central die composed of two central half dies acting in the direction of the head movement.

Such devices are described in more detail in British Patent Specification No. 733175 and No. 1 079 255 and in the U.S. Pat. No. 3,348,407. They are used for forging crank-shafts and like work pieces. They have a transversely acting central die arranged to displace an intermediate portion of a bar to be forged out of alignment with the longitudinal bar axis, and end dies arranged to grip the bar on each side of the central die and to approach one another in synchronism with the movement of the central die to upset or longitudinally forge the bar on each side of the displaced intermediate portion. In the known devices the central die is moved during the working stroke transversely to the longitudinal axis the forged bar. Therefore the material is bent or offset. These devices can be used for upsetting only, in thise case the central die must be removed. In such devices it is possible to perform only one upset during one working stroke.

The object of the invention is to provide a device which permits upsetting a rod or a tube simultaneously at two places in a given distance, or to manufacture branched shapes, like crosses, tees, X's, Y-shapes and the like from rods.

According to the present invention there is provided a forging device of the type specified wherein the central die, composed of two jaws, forms a gripper of the forged material, and the upsetting-tool holders coupled with the head by articulated connectors are shaped as angular elements, with arms situated transverse to the head movement and which are pressed in the direction of the head movement against the jaw of said gripper and are mounted slidably in a direction transverse to the head movement with regard to said jaw, whereas the other arms of the angular element are equipped with the upsetting tools.

In a preferred form of the invention the head of the forging device is equipped with adjustable guides, to which the articulated connectors are hinged.

In the forging device according to the invention each of the arms of the angular elements which are transverse to the head movement can be supported on the jaw of the central gripper by means of a half-roller, which is pivoted in one of said cooperating elements and is slidably mounted to the other of these elements.

In an alternative solution each of the arms of the angular elements which are transverse to the head movement is supported on the jaw of the central gripper by means of a roller.

The jaws of the central gripper can be shaped as half dies of the die, in the cavity of which the forging is shaped.

To the head of the forging device a punch may be fastened. The working part of the punch passes through openings in the jaw of the central gripper.

In the forging device according to the invention at least one upsetting tool can consist of two clamping jaws, of which one jaw is slidably mounted to the base, and the other jaw is fastened to that arm of the angular element, which is parallel to the head movement.

The device according to the invention can be mounted on a press as a supplementary apparatus or can be an independent machine with its own drive.

Constructional embodiments of the present invention will now be described by way of example with reference to the accompanying drawing, wherein.

Figure 1:
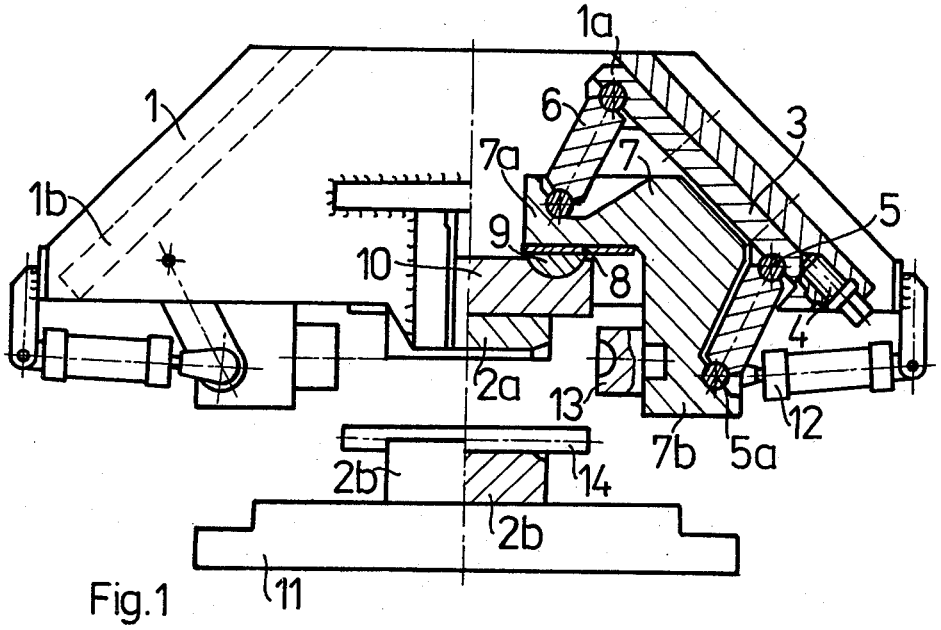
FIG. 1 shows a first embodiment of the forging device made in accordance with the invention, in open state, in side view and in vertical half-cross-section.

The device shown on the FIGS. 1 and 2 comprises a head 1 fastened to a press ram or other drive mechanism, a central gripper having two jaws 2*a* and 2*b* and connecting these elements, an upsetting-gripping mechanism, which will be described below.

The head 1 has two side arms 1*a* and 1*b*, branching out downwards and outside at an angle of 45° against the vertical. To each of the arms 1*a* and 1*b* of the head, a guide 3 is slidably fastened, whose position may be adjusted by screw 4. On each of the guides, two bearing rollers 5 of articulated connectors 6 are supported. The connectors 6 are hinged on these rollers at one side and on rollers 5*a*, fastened to angular element 7 at the other side. The horizontal arm 7*a* of each of angular elements 7 rests by means of a slidable plate 8 and a half-roller 9 on a plate 10, which rests on the upper jaw 2*a* of the central gripper. The half-roller 9 is pivoted in the plate 10, what allows accurate contact of mating surfaces. The lower jaw 2*b* of the gripper is fastened to base 11. Each of the angular elements 7 is connected to head 1 by means of a hydraulic cylinder 12, used for withdrawn both angular elements 7 with upsetting tools 13 fastened to them. Element 14 on the drawing indicates material to be forged.

The device according to the FIGS. 1 and 2 works in the following way: in open position, shown on the FIG. 1, material 14 to be forged is placed on the lower jaw 2*b* of the central gripper. This material juts out on both sides of the jaw of the gripper. Subsequently the drive is turned on, lowering the head 1 and together with it the whole upper assembly of the device.

Subsequently, at further movement of the head 1 downwards, the angle of inclination of the connectors 6 against the vertical increases and the angular elements 7 pressed by the connectors approach one another. Horizontal arms 7*a* of the elements 7 move parallelly pressing against the plate 10 and the upsetting of the tools 13 cause upsetting material 14 at both ends.

After completing the working stroke and withdrawing the head 1, receding of the angular elements 7 is achieved by means of the hydraulic cylinders 12. The stroke of the upsetting tools may be adjusted to a wide range by screws 4.

Figure 3:
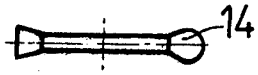
FIG. 3 shows the forging manufactured in the device according to FIGS. 1 and 2, in side view.

In particular, the guides 3 on the left and right arm of the head may be placed at a different height, which causes the left and right connectors to have different angles of inclination, and in consequence gives different working strokes of the left and right upsetting tools. This permits upsets of different size and shape on the two ends of the forged material 14, as shown on the FIG. 3.

Figure 2:
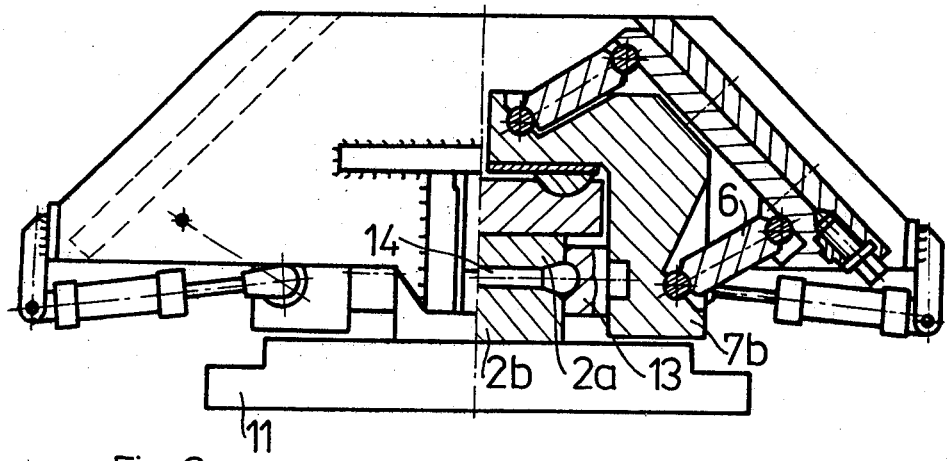
FIG. 2 shows the device according to FIG. 1 at the end of the working stroke.
Figure 4:
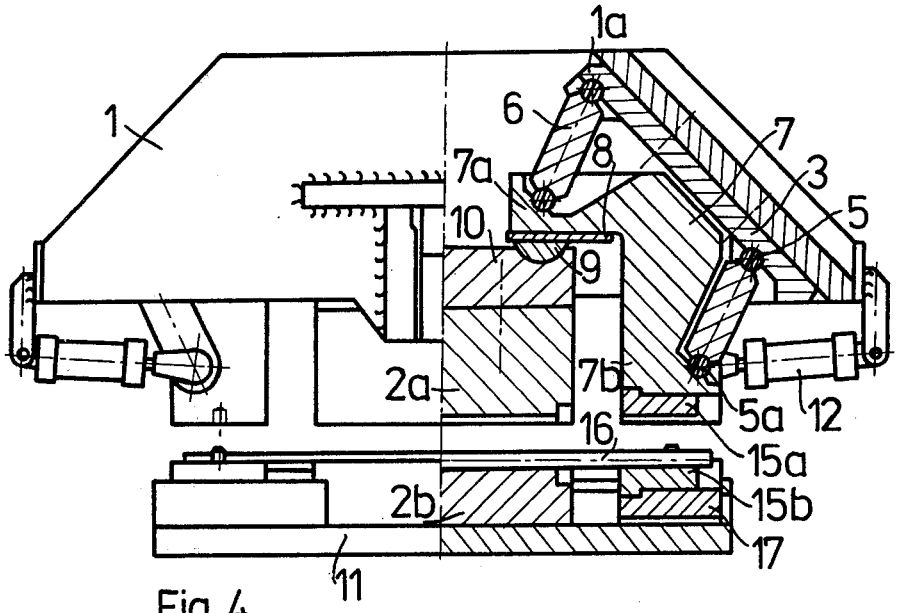
FIG. 4 shows a second embodiment of the forging device made in accordance with the invention, in open state, in side view and in vertical half-cross-section.
Figure 5:
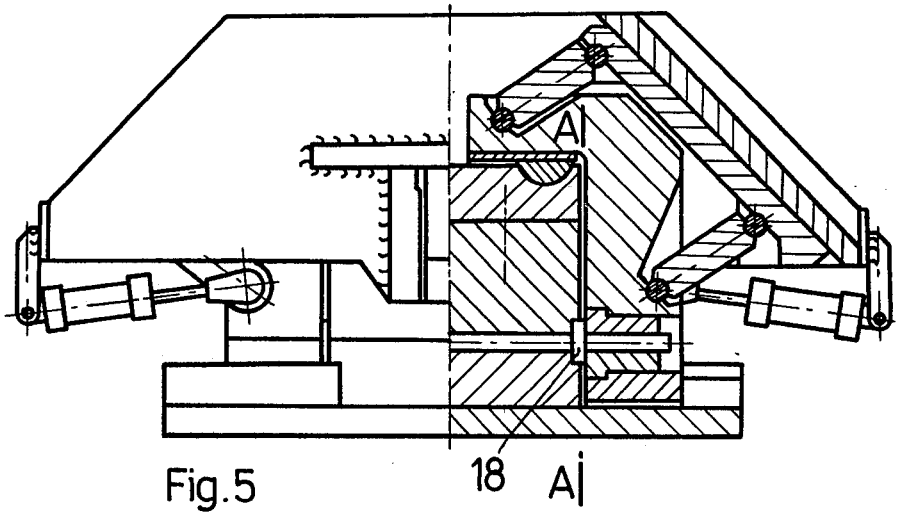
FIG. 5 shows the device according to FIG. 4 at the end of the working stroke.

The second embodiment of the device, shown on the FIGS. 4 and 5 is generally analogous to the one according to the FIGS. 1 and 2, only the upsetting tools are built differently. In this case each of the upsetting tools consists of two gripping jaws 15*a* and 15*b*, which grip the end of forged rod 16. The jaw 15*a* is fastened to the vertical arm 7*b* of the angular element 7, but the jaw 15*b* is fastened to the holder 17, slidably supported on the base 11.

Figure 7:
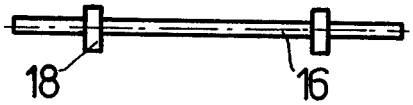
FIG. 7 shows a forging manufactured in the device according to FIGS. 4, 5 and 6 in side view.
Figure 6:
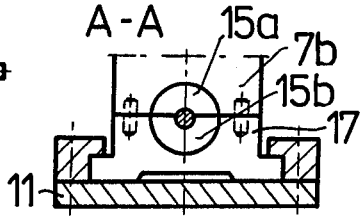
FIG. 6 shows a part of the device according to FIGS. 4 and 5 in cross-section along the line A—A on FIG. 5.

During operation of the device according to the FIGS. 4 and 5 the middle part of the rod 16 is gripped between the jaws 2*a* and 2*b* of the central gripper, but both outer parts of the rod 16 are clamped between two pairs of jaws 15*a* and 15*b*. During the working stroke, the two collars 18, shown on the FIG. 7 are upset.

Figure 8:
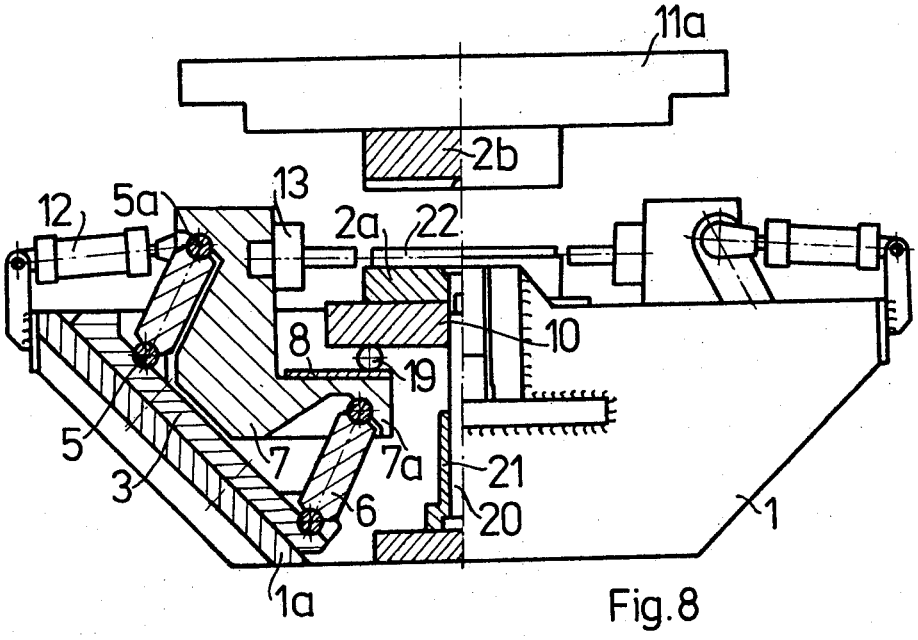
FIG. 8 shows a third embodiment of the forging device made in accordance with the invention, in the open state, in side view and in vertical half-cross-section.
Figure 9:
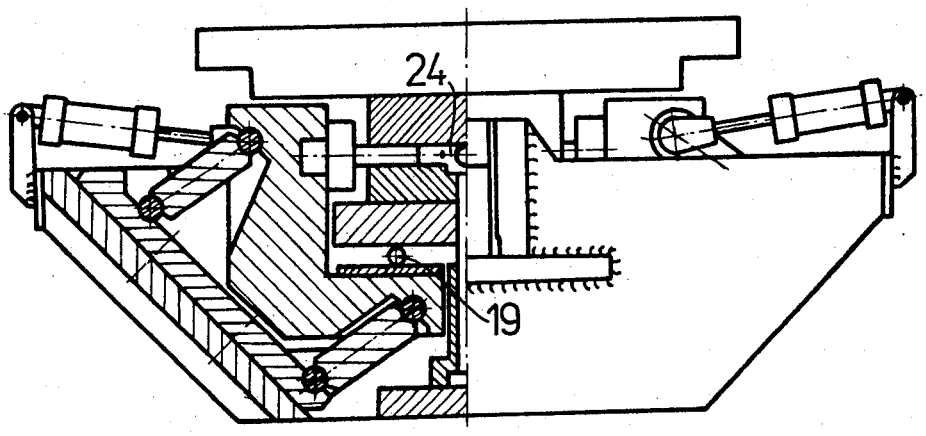
FIG. 9 shows the device according to FIG. 8, at the end of the working stroke.

In the third embodiment of this invention shown on the FIGS. 8 and 9 the device is assembled in an upside-down position against the horizontal axis, wherein head 1 rests on the base, for example a table of a press.

The plate 11*a* is fastened to a press ram.

Figure 10:
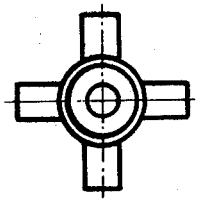
FIG. 10 shows a forging manufactured in the device according to FIGS. 8 and 9 in top view.
Figure 11:
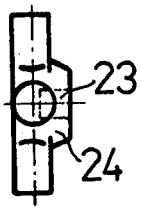
FIG. 11 shows the forging according to FIG. 10 in side view.

For transmission of the pressing force from the horizontal arm 7*a* of the angular element to the plate 10, being a support for the jaw 2*a* of the central gripper, the bearing roller 19 (instead of the half-shaft 9 used in the embodiment according to the FIGS. 1, 2 and 4, 5) is used. In the middle part of the head 1 punch 20 is, fastened to the holder 21. The jaws 2*a* and 2*b* form together a segment die, the cavity of which is the shape of a cross (FIGS. 10 and 11). The parts of the cavity shaping two opposite arms of the cross are closed at their outer ends. The two remaining parts of the die cavity shaping the two other arms of the cross are opened at their outer ends.

In the jaw 2*a* and the plate 10 central openings are formed, through which the punch 20 enters to the interior of the cavity of the die, formed by the jaws 2*a* and 2*b*.

The upsetting tools 13 have working parts of cylindrical shape and the diameter corresponding to the diameter of the forged cross arms.

During operation of the device according to the FIGS. 8 and 9 the material 22 is gripped between the jaws 2*a* and 2*b*.

During the working stroke the upsetting tools 13 press on the ends of the material 22 and cause its flowing to the cavities in the jaws 2*a* and 2*b*. Simultaneously the punch 20 makes a central relief 23 in the treated element.

As a result the cross 24, shown on the FIG. 10 and 11 is obtained.

I claim:

1. A forging device for mounting between the vertically moving head and the base of a forging press comprising a central work-piece, gripping tool positioned between two work-upsetting tools; said gripping tool comprising two jaws, one mounted to the head of the press and moving vertically therewith and the other mounted to the base and both co-acting to grip the work piece upon vertical movement of the head to said base; said upsetting tools moving transverse to the movement of said head and base, horizontally toward each other along the axis of the work piece held by said gripping tool, each upsetting tool comprising an upsetting-die holder and an upsetting-die mounted thereon, each die holder being coupled to the head by articulated connectors shaped as angular elements surrounding said holding tool having horizontal and vertical arms pivotably connected by bearing members to the press head, said horizontal arm pressing against the jaw mounted to the head to press same to said base mounted jaw; said horizontal arm sliding along said bearing surface directing said vertical arms transverse to the direction of the moving press head to converge said upsetting dies upon said work piece.

2. The forging device as claimed in claim 1 wherein the press head is equipped with adjustable guides, at which the articulated connectors are hinged.

3. The forging device as claimed in claim 2, wherein each of the arms of the angular elements transverse to the head movement is supported on the head mounted jaw of the gripper tool by means of a half-roller pivoted in one of the cooperating arms and is slidably mounted to the other of these arms.

4. The forging device as claimed in claim 2 wherein each of the arms of the angular elements transverse to the head movement is supported on the jaw of the gripper tool by roller means.

5. The forging device as claimed in claim 2, wherein the jaws of the gripper tool are shaped as half dies of a die, in the cavity of which the work-piece is shaped.

6. The forging device as claimed in claim 2, wherein a punch is fastened to the head, the working part of said punch passing through the opening in the upper jaw of the gripper tool.

7. The forging device as claimed in claim 2, wherein at least one upsetting tool comprises two clamping jaws one jaw being slidably mounted to the base and the other jaw being fastened to the arm of said angular element, parallel to the movement of said press head.

* * * * *